US005711470A

United States Patent [19]

Thompson

[11] Patent Number: 5,711,470

[45] Date of Patent: Jan. 27, 1998

[54] APPARATUS AND METHOD FOR ADJUSTING THE LATERAL POSITION OF A MOVING STRIP

[75] Inventor: Gary J. Thompson, Akron, Ohio

[73] Assignee: The North American Manufacturing Company, Cleveland, Ohio

[21] Appl. No.: 347,854

[22] Filed: Dec. 1, 1994

[51] Int. Cl.[6] ..... B65H 23/18; B65H 20/24; B23Q 16/00

[52] U.S. Cl. ..... 226/4; 226/16; 226/21; 226/45; 226/119

[58] Field of Search ..... 226/16, 21, 22, 226/23, 44, 45, 119, 4

[56] References Cited

U.S. PATENT DOCUMENTS

| | | | |
|---|---|---|---|
| 2,781,192 | 2/1957 | Gilfillan | 226/119 |
| 3,024,955 | 3/1962 | Powers, Jr. | 226/22 |
| 3,568,904 | 3/1971 | Kurz | 226/15 |
| 3,673,647 | 7/1972 | Koster | 226/22 |
| 4,648,539 | 3/1987 | Dingerkus | 226/19 |
| 4,898,094 | 2/1990 | Doumoto et al. | 226/4 |
| 5,058,793 | 10/1991 | Neville et al. | 226/15 |
| 5,072,414 | 12/1991 | Buisker et al. | 226/45 |
| 5,308,010 | 5/1994 | Hakiel | 226/21 |
| 5,318,796 | 6/1994 | Torpey et al. | 226/44 |

FOREIGN PATENT DOCUMENTS

| | | | |
|---|---|---|---|
| 0048790 | 4/1977 | Japan | 226/44 |
| 0033223 | 4/1981 | Japan | 226/21 |
| 0118565 | 6/1985 | Japan | 226/45 |
| 0030212 | 2/1986 | Japan | 226/45 |
| 0906473 | 9/1962 | United Kingdom | 226/23 |

*Primary Examiner*—Daniel P. Stodola
*Assistant Examiner*—Matthew A. Kaness
*Attorney, Agent, or Firm*—Vickers, Daniels & Young

[57] ABSTRACT

Method and apparatus for guiding a strip traveling along a selected path past a first location on the path and then past a second location on the path, which method and apparatus comprise correcting the camber of the strip at the first location toward a first guide point, sensing the amount of correction at the first location, correcting the camber of the strip at the second location toward a second guide point, sensing the amount of correction at the second location and adjusting the first guide point based upon the relationship between the amount of correction at the first and second locations. In addition, there is provided an improvement in a strip guiding system for adjusting the phase lag between spaced guiding locations based upon a variable length of strip between the locations.

32 Claims, 6 Drawing Sheets

APPARATUS AND METHOD FOR ADJUSTING THE LATERAL POSITION OF A MOVING STRIP

The present invention relates to the art of controlling the lateral position of a moving strip and more particularly to a method and apparatus for guiding a moving strip.

INCORPORATION BY REFERENCE

U.S. Pat. No. 3,568,904 is incorporated by reference herein as disclosing both a single control loop and a dual control loop sample data strip guiding system wherein an output signal from a remotely positioned edge detector is used to control the direction and amount of corrective action at the payout position of the strip. A periodic error sample is taken when a pulse generator determines movement of a given length of strip from the payout roll to the remote control point. In accordance with the single loop concept, the actuator for changing the position of the strip is controlled directly by the periodic error sample. In the dual loop concept, the guide point or offset point of a second sensor or edge detector adjacent the strip payout reel is adjusted by the periodic error sample so that a primary loop servomechanism, including the actuator, is modified by the periodic error sample. This is done by changing the guide point of the closely spaced edge detectors or by moving the edge detectors with respect to the strip on the basis of a remotely created error sample. The dual loop concept can include a primary feedback loop where the remote secondary loop adjusts the set point or guide point of the primary loop. This patent is incorporated by reference herein as background information and as illustrating types of control systems in which the present invention can be employed. The technology disclosed in this prior patent need not be repeated herein to understand the present invention.

U.S. Pat. No. 4,648,539 illustrates a strip guiding system employing remotely located edge detectors that create an error signal which is the difference between the actual position of the moving strip and the desired position of the moving strip at a remote location. This error signal is then multiplied by a continuous speed signal and is integrated for stability to adjust the set point or guide point of a primary control loop of the servo-mechanical type. This prior system is a continuous system as distinguished from the sampling system employed in the above mentioned patent and as used in the present invention. This second patent is incorporated by reference herein to illustrate a remote edge detector that can control the set point or guide point of a primary, feedback loop mechanical system employing an actuator which is adjusted in accordance with the actual position of the actuator as compared with a set point or guide point. Technology contained in this second patent need not be repeated for an understanding of the present invention. This prior patent forms further background information regarding the technology to which the present invention is directed.

U.S. Pat. No. 5,058,793 is also incorporated by reference herein to illustrate an analog system for creating an error signal at a remote location.

The present invention relates to a digital system operated by a microprocessor; however, the technology discussed in the various patents incorporated by reference herein, even if analog systems, are background information showing the technology associated with the invention and used for controlling the position of a strip passing through a guide system.

BACKGROUND

The present invention relates to the concept of controlling the lateral position of a moving strip at a remote location substantially spaced from a payout reel or a steering roll by adjusting the position of the payout reel or a steering roll with a mechanical actuator based upon the positional error detected at the remote position; however, the invention has application to various types of strip guiding systems, such as a system wherein the offset of edge detectors close to the payout reel is adjusted by the error sensed at a remote position or the set point of an edge detector or a primary control loop adjacent the reel or steering roll is adjusted by the error detected at the remote position. These various types of systems will be described and can employ the inventive concepts of the present invention. The invention can be used to adjust a payout reel and will be discussed with respect to this type system; however, the invention has broader applications and can be used to adjust a steering roll or other strip position correcting devices in a strip guiding system.

Strip guiding systems generally employ a sensor adjacent the payout reel which determines the position of the strip as it moves from the payout reel. As the sensor detects deviation from a desired position, a signal is created that shifts an actuator on the payout reel to adjust for the detected error. If these sensors are located closely adjacent the payout reel the adjustment may not control the strip alignment at a remote location where such alignment is required. Thus, in accordance with somewhat standard practice, edge detectors are often placed at a remote control point where the edge of the strip is to be accurately positioned. Since the control point is substantially remote from the actuator used to control the position of the strip, control stability is quite difficult. To increase the stability, the remote detector has, in the past, been periodically interrogated to determine the amount and direction of any error between the actual strip position and the desired strip position at the control point. This error is used to create an error signal or sample to adjust the primary correcting mechanism at the payout reel. If the primary adjusting mechanism at the reel is a closely positioned edge detector which creates its own error signal through comparison with a set point or guide point, the remotely created error signal or sample is employed for adjusting the set point or guide point of the primary correcting mechanism, known as the conventional primary control loop.

Prior systems of the type explained above have used a data sample system wherein the magnitude of the error detected at the remote control point is periodically used to update an analog signal which forms a reference value that is employed at the primary conventional control loop to change the offset or guide point of the primary loop. This update is accomplished periodically at a rate determined by the time during which a particular length of strip passes the control point. This time is usually adjusted to correspond with the distance of the remote edge detectors or sensors from the primary conventional control loop employed for correcting the position of the moving strip.

In the past, these systems using a remote edge detector to adjust the conventional primary control loop have been somewhat slow in response and have involved a certain amount of hunting and a lack of system stability. In addition, when a substantial edge deviation is detected at the remote control point, correction at the primary loop sometimes requires a substantial amount of time due to the inherent circuit limitations heretofore employed. For instance, the rate of correction is independent of the magnitude of the error in the system of U.S. Pat. No. 3,568,904; consequently, large errors require substantial correction time. Also, prior mechanical systems have less accurate system response than digital systems.

Even when using the improvement of U.S. Pat. No. 5,058,793, strip guiding systems employing remotely located edge detectors or other sensing arrangements have still had certain limitations especially when a large number of correcting rolls are included in the system. In some systems, the primary conventional control loop controls the entry position of the moving strip; however, a number of longitudinally spaced camber correcting devices are provided along the path of the strip. Each of these camber correcting devices includes a guide roll over which the strip passes, together with an edge detector or other type of position detecting device for determining the lateral position of the strip as it moves over the guide roll. As the strip moves from its centered position, a feedback control device, similar to the control device associated with the conventional primary control loop, shifts the guide roll by an actuator to correct any lateral deviation of the strip exiting from the roll. To accomplish this camber control, each of the feedback control devices at the individual guide rolls has a set guide point which the feedback control device uses to compare the actual exiting position of the strip to determine the amount of correction of the guide rolls. These camber correcting devices or strip correcting devices are mounted at spaced locations along the path through which the strip being controlled is traveling. A disadvantage of the prior art devices having two or more individually actuated strip position controlling means has been that a minor error at one guide roll is magnified as the strip moves to a remote guide roll. It has been found that slight errors in the lateral displacement of the moving strip accumulate, from guide roll to guide roll, so that a strip entering a subsequent camber correcting device on the moving path of the strip will already be drastically shifted from a centered position. This displacement of the strip causes the subsequent strip position correcting means, or camber control rolls, to generate substantial correction. Since each guide roll actuator has a maximum amount of correction which it can accomplish, small errors accumulated through the process line require the maximum correcting abilities of subsequent guide roll stations to be a limiting factor in the width of the strip which can be processed by the line. When the strip causes maximum displacement at a subsequent strip guide roll, corrective measures must be taken. The basic corrective measure, when processing strip having substantial camber problems, is to reduce the width of the strip being processed, increase the number of guide rolls or use substantial operator intervention in adjusting the strip guiding system.

THE PRESENT INVENTION

The present invention overcomes the disadvantage of a guiding system requiring a number of downstream, substantially spaced, strip correcting devices, such as camber correcting rolls, so that such systems can process wider strips than heretofore possible without maximizing the guiding capabilities at subsequent guide rolls. By using the present invention, the number of guide rolls at spaced locations along the path of the moving strip need not be increased as the width of the strip is increased or the quality of the camber of a strip is low. In accordance with the present invention, there is provided an apparatus and method for guiding a strip traveling along a selected path past a first location on the path and then past a second location on the path. The apparatus and method includes a first camber correcting means for adjusting the lateral position of the moving strip toward a first guide point at the first location and a transducer or other means for sensing the amount of correction at this first location. A second camber control or strip adjusting device is located at the second location and is used to adjust the position of the moving strip toward a second guide point, with means for sensing the amount of correction of the strip at the second location. In this manner, each of the first and second strip correcting, or camber controlling, devices adjusts the lateral position of the moving strip toward a set guide point associated with the feedback control loop of each of the strip correcting devices, or camber control mechanisms. As so far described, a small amount of displacement of the moving strip at the first location would be magnified at the second location so that maximum corrective capabilities of the second strip correcting mechanism, or camber control device, would be reached before the correcting capability of the mechanism or device at the first location approaches its maximum capacity. In accordance with the invention, the method and apparatus includes means for adjusting the first guide point at the first location, based upon the relationship between the amount of correction of the first and second locations as sensed at those two locations. In accordance with the invention, the amount of correction at the subsequent location is compared to the amount of correction at the first location and the guide point of the first location is adjusted accordingly. In this manner, assuming that there is 100% correction at the second location and only 50% correction at the first location, the guide point of the feedback control loop of the device at the first location is adjusted by 25% so that each of the adjusting systems operate at approximately 75% of their capacity. This same type of control is employed between each of two subsequent strip control mechanisms at individually spaced locations along the path of the strip. If several guide roll stations are used in the path of a moving strip, the subsequent guide rolls adjust the previous guide rolls. This action progresses all the way back to the payout or conventional primary control loop at the start of the processing line.

As a more detailed description of the present invention, there is provided an apparatus for guiding a strip traveling along a selected path past a first location on the path and then past a second location on the path. This same concept is employed between subsequent guide rolls in a series of guide rolls. In accordance with this more detailed aspect of the invention, there is a first strip position correcting means engaging the strip at the first location for changing the position of the strip as it moves from the first location toward the second location. This is a standard correcting technique for moving strip to maintain the strip in a centered position in the guide system. There is also a similar standard second strip position correcting means engaging the strip at the second location for changing the position of the strip as it moves from the second location to a subsequent location on the path. These first and second strip position correcting mechanisms, or camber control devices, each include an actuator for shifting strip position on the path in a lateral direction and a feedback control device that creates a signal indicative of the actual position of the moving strip at the actuator device and an adjustable guide point so that the feedback control device adjusts the actual strip position indicated by the actual strip signal toward the guide point merely by moving the actuator device. These mechanisms are standard in the trade. A transducer is employed for reading or sensing the extent of the actuated condition of the actuators at each of the two spaced locations to determine a position between a first condition approximating the full actuated condition of the actuator and a neutral condition wherein the strip is not shifted by the control device. By using a transducer, the amount of correction being accomplished at the longitudinally spaced locations is determined.

The transducer sensing mechanisms at the two locations, which sense the amount of correction being accomplished, operate between two conditions. It is within the contemplation of the invention that these conditions are (a) fully actuated and (b) centered or neutral; however, it would be within the skill of the art to have two other conditions, one near the full actuation and the other near the centered. Other movement ranges of the transducers are equivalents when using the present invention. Two signals are created which are representative of the magnitudes of correction being accomplished at the two spaced locations. These two signals are subtracted or otherwise compared to create a proportional signal which, in the preferred embodiment, is a number indicative of the difference between the correction magnitude of the first and second locations. The proportional signal is then used to adjust the guide point of the first strip position correcting means at a prior location in the direction in which the strip is moving. By changing the guide point of the first location based upon the difference between the correcting magnitude of the first and second locations, a balance of the amount of correction between the two locations is obtained. The invention can be used between any of two spaced locations in which there is a feedback control device for sensing the actual position of the moving strip, comparing that position with a guide point and then adjusting the actuator to correct the position of the strip for the purpose of reducing the difference between the actual position and the guide point. Such mechanisms are at the payout of the strip as well as on the path in which the strip travels. The spacing of the locations is generally over about 50 feet. The first and second locations may have intermediate non-correcting guide rolls or idler rolls which are not necessarily affected by the use of the present invention. In other words, a strip guiding system having several feedback control arrangements for adjusting the camber of the moving strip can employ the present invention for balancing the amount of correction of the strip in a subsequent location with the correction of the strip at a prior location. These spaced locations are referred to as the "first" and "second" locations.

In accordance with another aspect of the present invention, the proportional signal is multiplied by a value to control the gain or amount of correction accomplished periodically from the subsequent location to the prior location. In accordance with standard practice, a phase lag feature is employed between the spaced strip correcting locations. The standard phase lag concepts are employed whereby a tachometer measures the speed of the moving strip to determine the update rate used in correction of the guide point.

The primary object of the present invention is the provision of a method and apparatus for guiding a strip along a selected path between a first location on the path and past a second location on the path, which method and apparatus continuously balances the amount of corrective action between the first and second locations.

Yet another object of the present invention is the provision of a method and apparatus, as defined above, which method and apparatus allows for the use of a lesser number of strip correcting stations along the path followed by the strip and/or allows the use of strip having excessive camber or greater width.

A further object of the present invention is the provision of an apparatus and method, as defined above, which apparatus and method is primarily digital in operation and controlled by a microprocessor and can be used with standard camber control or other strip position correcting mechanisms commonly employed for strip guide systems.

Another object of the present invention is the provision of a method and apparatus, as defined above, which method and apparatus continuously balances the amount of correction between two locations on a strip guiding system without causing the adjustment to be accomplished after the strip has exceeded a set maximum adjusting position at subsequent locations.

These and other objects and advantages will become apparent from the following description taken together with the accompanying drawings.

PREFERRED EMBODIMENT OF THE INVENTION

Figure 1:
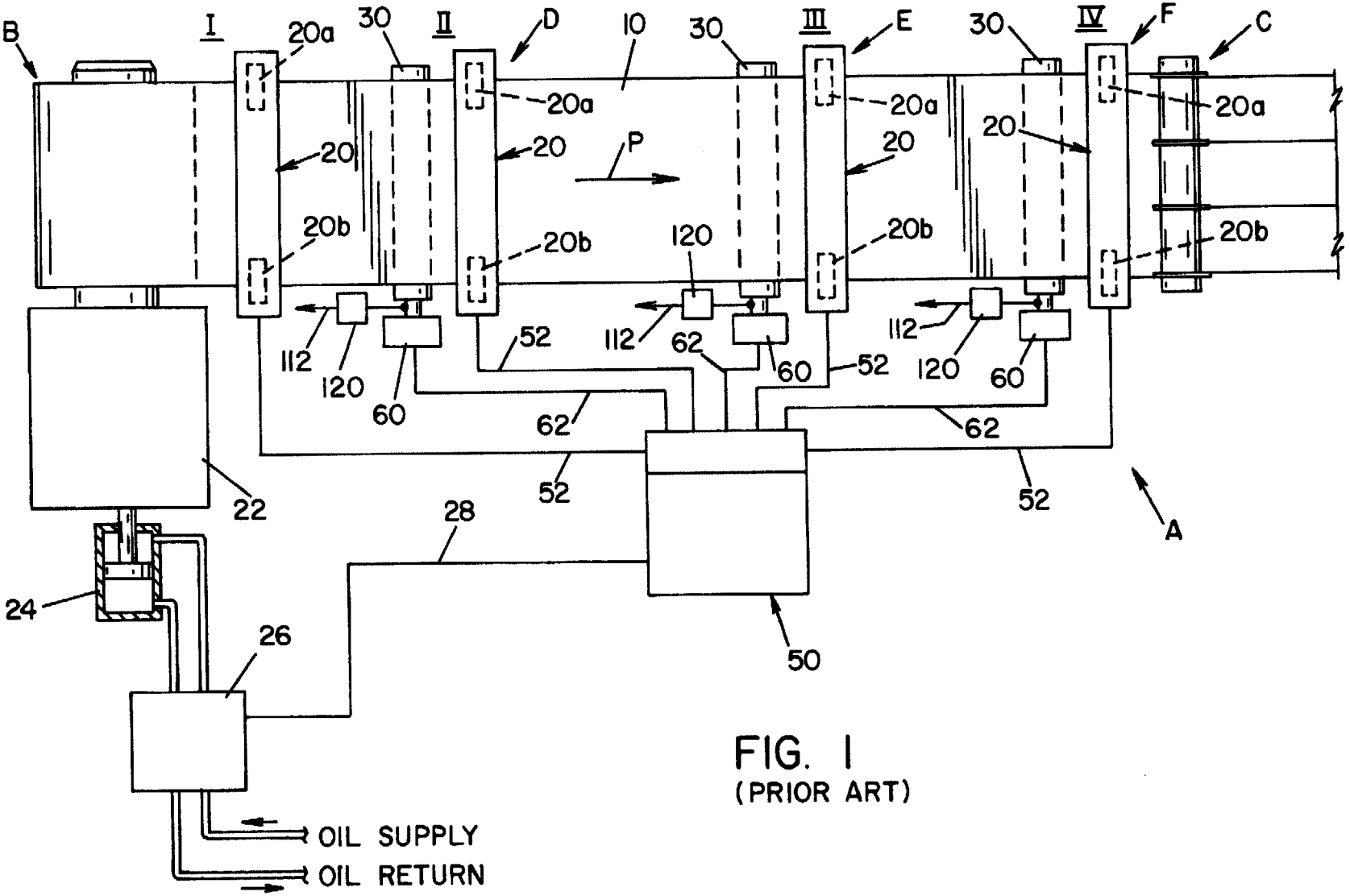
FIG. 1 (PRIOR ART)
FIG. 1 is a schematic diagram and top view of a prior art strip centering system employing a series of strip correcting devices at spaced locations along the path of the moving strip and using the present invention.

Referring now to the drawings wherein the showings are for the purpose of illustrating a preferred embodiment of the invention only and not for the purpose of limiting same, FIG. 1 shows a prior art system A used for guiding the strip wherein the strip 10 must be centered immediately before being slit by slitter C.

Figure 2:
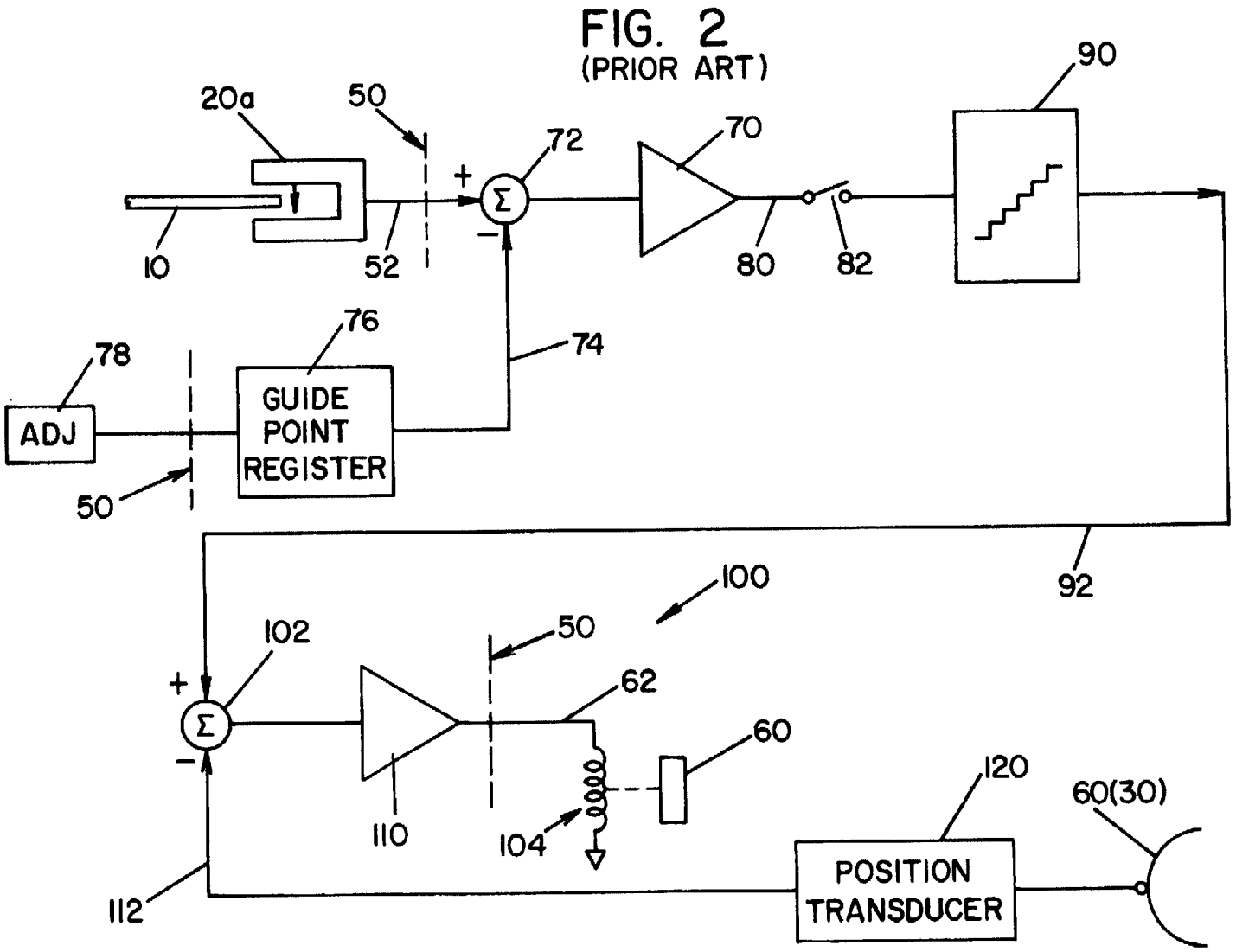
FIG. 2 (PRIOR ART)
FIG. 2 is a schematic block diagram of a prior art two loop strip guiding system employing a remote edge detector and a mechanical servo mechanism with a mechanical feedback for adjusting the position of the strip.

In this schematically illustrated prior art system, payout reel B is employed for controlling the position of the moving strip 10 as it passes along path P between the payout reel B and the subsequent slitter C. Payout reel B is at location I. Subsequent strip positioning devices D, E, F, are at locations II, III, and IV along path P. Each of the strip position correcting means or positioning devices includes an edge detector 20 with axially spaced edge detector elements 20*a*, 20*b*, which elements may be light sensitive edge detectors or any other elements for determining the lateral position of strip 10 as it leaves the guide roll 30 or reel B. In accordance with standard technology, a double acting hydraulic cylinder 24 is operable in two directions to control the payout position of reel B on which the coil strip 10 is mounted. A control motor 26 receives a command signal in line 28. This command signal indicates deviation of actuator 22 from a desired position as determined by the primary edge detector 20 at location I. Although a single edge detector element could be employed, the illustrated prior art embodiment is for centering strip 10; therefore, two axially spaced detector elements 20*a*, 20*b* are employed. The output of detector 20 is the actual position of strip 10 at locations I, II, III and IV which actual position is directed to microprocessor 50 by lines 52. Lines 52 provide signals indicating the centered position of strip 10 as it passes through one of the locations I–IV. In accordance with standard practice, each of the rolls 30 has a guide point which is the number or position to which the actual position of strip 10 is compared for the purposes of tilting rolls 30 by strip position correcting means B, D, E or F, each having an actuator 60 or actuator 22. As so far described, system A is constructed in accordance with the prior art having strip correcting devices or camber control rolls 30 at the longitudinally spaced positions for guiding strip 10 as it moves along path P toward an outlet mechanism such as slitter C. The adjustment of a mechanical actuator 60 for correcting the position of strip 10 is controlled in accordance with a command signal in line 62. This command signal is like command signal 28 for the primary conventional control loop at location I. The actual control processing device is microprocessor 50 which performs functions schematically illustrated in FIG. 2, wherein the signal in line 52 is the signal indicative of the centered position of strip 10. The signal in line 52 from edge detector 20 is directed to an error amplifier 70 having a standard summing input junction 72 where one input 74 is the guide point stored in register 76 and adjusted by operation of block 78. Guide point register 76 is used in a digital system whereas the illustrated embodiment of FIG. 2 is shown in analog format. Register 76 is a potentiometer, in its analog format. The digital implementation stores a number in register 76, which number is adjustable by block 78. The analog signals directed to summing junction 72 are representative of the actual strip position, which signal appears on line 52 (as a number when digital) and representative of the guide point, which signal appears in line 74 (as a number when digital). The output of the summing junction 72 is directed to error amplifier 70. The voltage, or number, on line 80 is indicative of the actual position of strip 10, as compared to the desired position determined by the guide point value appearing in line 74. Schematically illustrated switch 82, which is a digital switch, is closed at a rate or pulsed at a rate depending upon the spacing between actuator 60 and detector 20. In the illustrated embodiment of FIG. 1, there is no spacing to require a phase lag control; however, the phase lag control concept is illustrated in FIG. 2 since the detector 20 is often spaced substantially from roll 30 and locations I, II, III and IV are spaced in a system using the present invention. Pulses from a tachometer are counted to determine when a given length of strip 10 has passed detector 20. This is in accordance with standard practice and will be discussed in connection with the preferred embodiment of the present invention. By counting the pulses from a tachometer, a sampling of the voltage level on lines 80 can be made when a precise length of strip has moved along the control path. Consequently, closure of the schematically illustrated switch 82 directs the voltage level on line 80 to a stepping function generator or mechanical position monitor 90, in the analog form of a motion driven potentiometer. Monitor 90 has an output on line 92 which is a voltage that increases according to the voltage on line 80 when the voltage on line 80 has a positive polarity. The voltage on line 92 decreases according to the error voltage on line 80 when the voltage on line 80 has a negative polarity. Thus, the analog voltage on line 92 is a reference value indicative of the updated displacement of strip 10 as it leaves one of the spaced rolls 30. When the detector 20 is spaced from roll 30 a phase lag control is employed. Such control includes the position monitor 90. This prior art system is illustrative in nature and shows an analog system even though the present system is a digital processing of the analog concepts. The voltage level on line 92 is directed to a control loop 100 and employed to adjust mechanical actuator 60 according to voltage across position controlled drive 104. The voltage from amplifier 110 controls the speed and direction of movement of actuator 60. The actual position of the actuator is normally converted into a voltage by a potentiometer that is a normal input 112 to summing junction 102. The potentiometer is schematically illustrated as the position transducer 120 also schematically illustrated in FIG. 1. The other input to summing junction 102 is the error signal (voltage or number) on line 92, as determined by the displacement strip 10 from the guide point in register 76. The features of the analog system illustrated in FIG. 2 and used in the invention are performed digitally by microprocessor 50, which concept is represented by the boundaries shown as dashed lines numbered 50 in FIG. 2. Position transducer 120 determines the actuated position of roll 30 or actuator 60 which position creates an analog signal in line 112 which in the invention is digitized. All the signals are digitized in the preferred embodiment of the present invention. The phases log concept shown in FIG. 2 utilizing monitor 90 is normally employed when the detector 20 is spaced from actuator 60. Such a system could employ the present invention; however, in the preferred embodiment of the present invention detector 20 is located close to the guide rolls, or camber correcting rolls 30, and need not include an individual phase lag control based upon the spacing between the detectors and the actuator.

Figure 3:
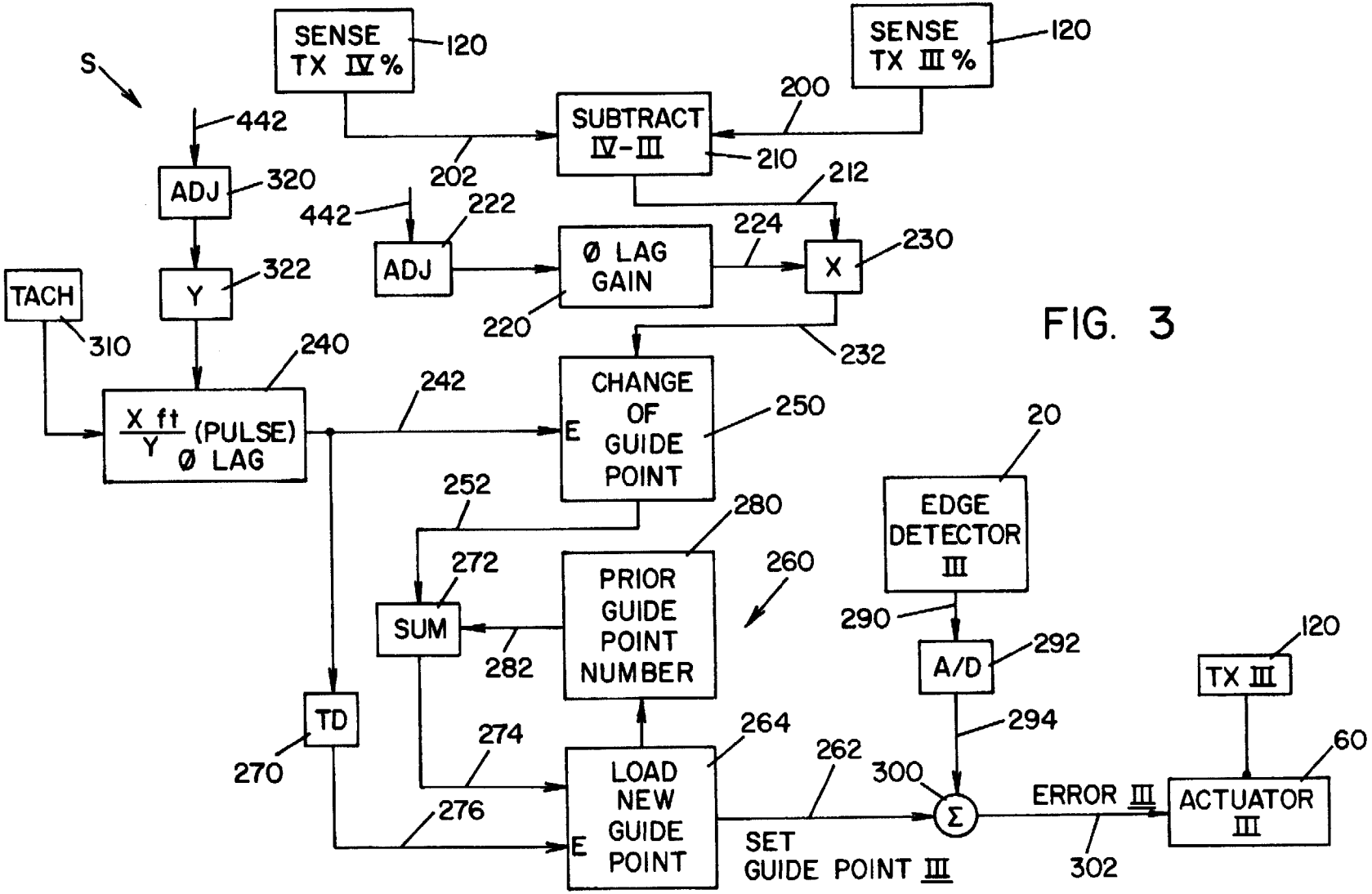
FIG. 3 is a schematic block diagram of the preferred embodiment of the present invention used in the system shown in FIG. 1 with features of the system shown in FIG. 2.
Figure 4A:
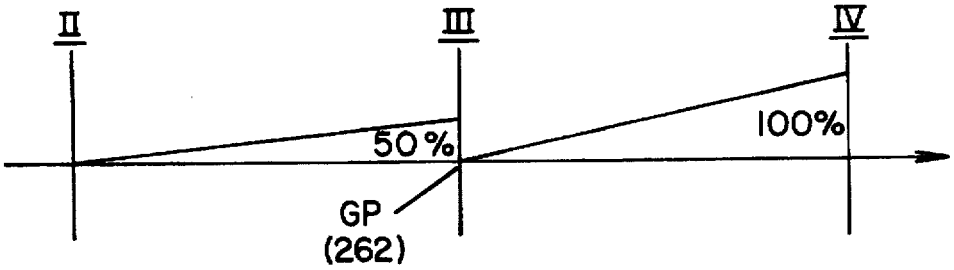
FIG. 4A (PRIOR ART)
FIG. 4A is a graph showing an operating characteristic of multiple corrective roll guide systems, without employing the present invention.
Figure 4B:
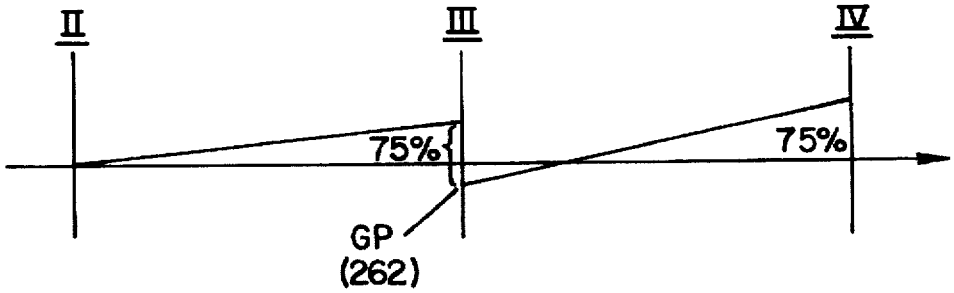
FIG. 4B is a graph as shown in FIG. 4A with the guide system employing the present invention.

Referring now to FIG. 3, the preferred embodiment of the present invention is illustrated wherein the digitally operated control system changes the guide point at a prior location in path P based upon the amount of corrective action being taken at a subsequent location. In the illustrated embodiment of the invention, the control of the guide point at location III by the amount of corrective action at location IV is illustrated. Of course, the same guiding system improvement is provided between locations II and III and between locations I and II. In the latter instance, the corrective action in accordance with the invention is adjustment of the payout reel B. Indeed, the invention could be used between locations I and II, etc. Transducers 120 at locations III, IV provide a first correction magnitude signal in line 200 and a second correction magnitude signal in line 202, respectively. In practice, the signals in lines 200, 202 are numerical signals indicating the amount of correction sensed by transducers 120 between a first condition, which is near maximum corrective action of actuator 60 and a second condition which is near perpendicularity of the roll 30 to create no strip corrective action. Consequently, the digital signals in lines 200, 202 are numbers representing the percentage of corrective action taken at locations III, IV. Without the present invention, as shown in FIG. 4A, the corrective action of actuator 60 at location IV can reach its maximum movement or full actuated condition, when the actuator 60 at prior location III is only operated at 50% of its travel. In accordance with the present invention, as shown in FIG. 4B, the guide point GP is shifted at position III so that there is a balancing action of the amount of actuator operation between the two positions, with both actuators operating at approximately 75% of full travel or movement. By using this concept at spaced locations, the amount of actuator action is adjusted and balanced from location to location so that none of the subsequent strip position correcting devices reach full travel while prior devices are at relatively low travel. In this manner, fewer corrective rolls can be employed. When using a selected number of corrective or camber control rolls, a relatively wider strip or a strip having more camber can be processed in system A as shown in FIG. 1. In accordance with the present invention, digital signals in lines 200, 202 are processed by proportional signal creating device 210 which, in the illustrated embodiment, subtracts the value of the number on line 200 from the value or number of the signal on line 202. This comparison action creates a proportional signal in line 212 defining the corrective action to be taken when adjusting the guide point at location III. Since the corrective action is to be performed gradually, there is a phase lag gain control device 220 which produces an adjustable gain for the proportional signal in line 212, which gain is created as a number in output line 224. The gain signal, which in practice is 0.01 is multiplied by multiplier 230 by the proportional signal or number in line 212. As an example, assuming that the corrective action of actuator 60 at location IV is 100% and there is no correction in position III, the difference between the signal in line 200 and the signal in line 202 would be 100%. With a gain of 0.01 there is a 1.0 inches changes in the guide point for position III, which value indicates that the guide point is to be shifted approximately 1.0 inch by the invention illustrated in FIG. 3. The different signal with the time multiplied therewith appears on line 232, which is a number representing the amount of correction which is to be implemented periodically by an update pulse from phase lag control device 240, in accordance with standard practice in strip guiding systems. The signal or number at line 232 is analogous to the signal of the remote detector 20 in the prior art device shown in FIG. 2. Such signal must be periodically updated by monitor 90 before used to control the guide point at location III. The pulse output of the system shown in FIG. 3 is represented by line 242 extending from device 240. A pulse in line 242 enables circuit or routine 250 and has a pulse rate based upon the length of strip between locations III and IV. Circuit or routine 250 creates a periodic signal in line 252 which periodically adjusts the guide point at position III in accordance with the pulse rate from phase lag control device 240. The use of a phase lag control device for a remote sensed condition in a strip guiding system is well known practice. Circuit 260 at the lower portion of FIG. 3 is used to create a new guide point in line 262, which new guide point is stored as a number in register 264. A delay device 270 enables register 264 upon creation of a pulse in line 276 after a pulse has been created in line 242 from phase lag control device 240. Device 272 sums the prior or old guide point, as stored in register 280 and appearing in line 282, with the change in guide point on line 252. This summing action creates a number in line 274 corresponding to the new guide point. This new guide point number is loaded into register 264 upon receipt of a pulse at the enabling pin of this register from line 276. By using delay 270, the new guide point appears in line 274 before the enable signal is created in line 276. The desired adjusted or new guide point in line 262, as stored in register 264, is adjusted between the low value of actuator transducer 120 at position III and the high value of transducer 120 at position IV. At position III, detector 20 creates an analog signal in line 290 representing the actual lateral position of strip 10 and analog to digital converter 292 converts the actual position signal in line 290 to a digital signal in line 294. This actual position signal is directed to error circuit 300 to create an error signal on line 302, similar to the error signal 62 shown in the prior art device of FIG. 2. The error signal on line 302 shifts actuator 60 at location III. The new position is sensed or read by transducer 120 at this same location.

By using the present invention, as illustrated in FIG. 3, a new guide point GP for the position correcting device E at location III is continuously created to balance the amount of actuation of actuator 60 at the two locations III and IV. In accordance with standard practice, the phase lag control device 240 is a counter that counts to a given number determined by the length X of strip 10 between locations III and IV and by a sensitivity value Y, which in practice is approximately 8–10. Thus, counter 240 forms the phase lag control device of the system illustrated in FIG. 3. Pulses from tachometer 310 are counted. When a number in counter 240 is reached, a pulse is created in line 242 to circuit or routine 250. As the speed of the Strip increases, the pulse rates increase to compensate for the length of the strip between positions III and IV.

Figure 5:
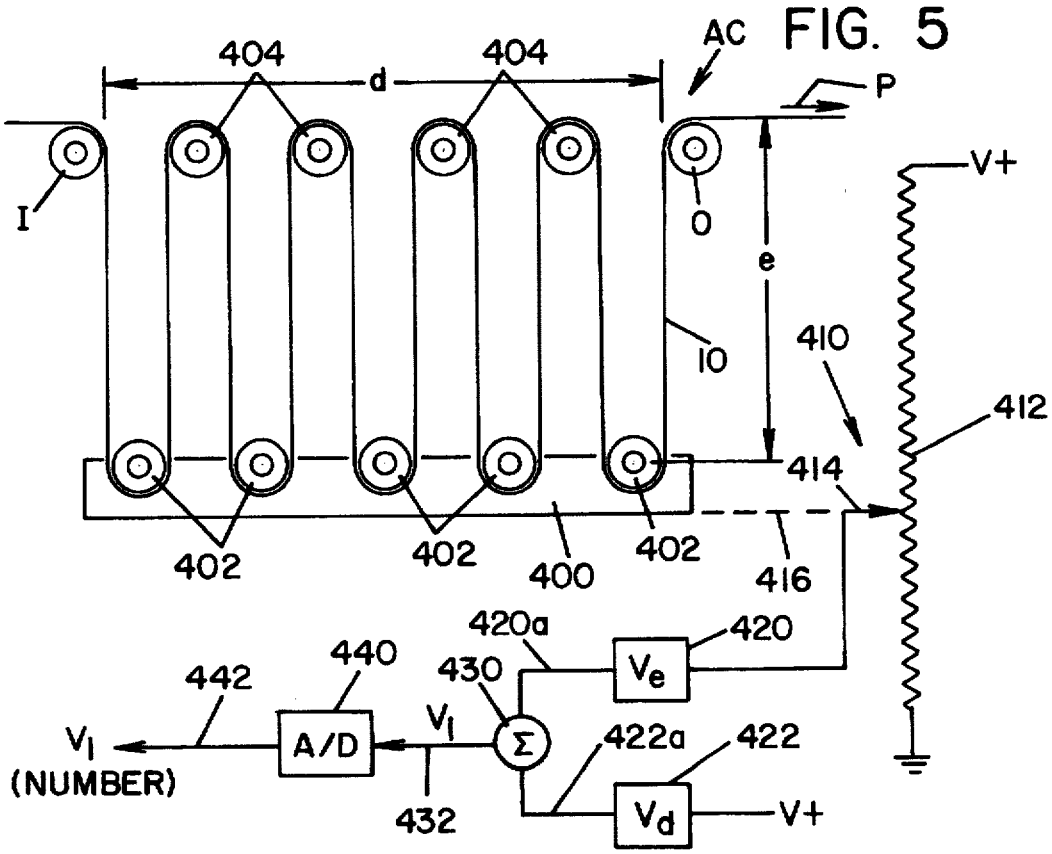
FIG. 5 is a schematic layout of an accumulator between first and second locations in the path of the moving strip for modifying the operation of the preferred embodiment of the present invention together with a block diagram of the electrical circuit of this arrangement.

In accordance with an aspect of the present invention, a standard strip accumulator AC, as shown in FIG. 5, is used between two of the positions in system A as shown in FIG. 1. In the illustrated embodiment, accumulator AC is located between positions III and IV. Thus, the length of strip X between these locations changes according to the amount of strip 10 in accumulator AC between inlet guide roll I and outlet guide roll O. The stored number in counter 240, in accordance with an aspect of the invention, is continuously adjusted in real time by device 320 to adjust the sensitivity value Y, as illustrated by block 322. This adjustment is based upon the length X of strip 10 in accumulator AC. As the amount of strip in accumulator AC increases, sensitivity number Y is increased directly and proportionally. This decreases the pulse rate in line 242. As an aspect of the invention, the phase lag control device 240 is adjusted based upon the actual length X of strip between the monitored locations III, IV to accommodate the use of an accumulator AC between these locations.

Accumulator AC has input roll I and output roll O, with the length of strip 10 between rolls I, O being determined by the vertical position of a weighted movable frame 400 having several idler rolls 402 coacting with upper fixed rolls 404 for guiding strip 10 in a serpentine path between roll I and roll O. As frame 400 moves downward, increased strip length is created between locations III and IV. A position indicator 410 is provided in accordance with this aspect of the present invention. A representative type of indicator 410 includes a potentiometer 412 with a movable contact 414 connected to frame 400 by an element represented as a dashed line 416. The voltage across potentiometer 412, in practice, is 10 volts. The portion of the voltage of the potentiometer determined by the location of contact 414 is a voltage directed to block 420 having an output 420*a*. Voltage $V_e$ represents the vertical position of frame 400, as represented by height between guide roll O and idler rolls 402. A fixed voltage $V_d$ is provided at the output of block 422 on line 422*a*, which voltage is generally proportional to the length d between guide rolls I, O. The summation of the two analog voltages is accomplished by summing junction 430 having an output analog signal on line 432 which is voltage $V_1$. This voltage is converted to a digital number on line 442 at the output of analog to digital converter 440. The voltage or number on line 442 is used in the embodiment of the invention illustrated in FIG. 3 to change circuit 222 for adjusting the gain of the proportional signal in line 212. In addition, the number in line 442 is used to adjust the value of sensitivity number Y, as shown by sensitivity adjuster S and as indicated by block 320. Of course, the strip length value X of phase lag control device 240 could be inversely adjusted by the number on line 442. In practice, the only adjustment by the number in line 442 is a change in the sensitivity number Y of the counter 240 used in the phase lag control device. In another embodiment of the invention, the number in line 442 is used to adjust only the gain at gain device 220. A third embodiment utilizes the number on line 442 for controlling both gain and phase lag. By having a voltage or number in line 442 representing the adjusted length of strip 10 between locations III and IV, the number can either adjust the gain to determine the amount of the periodic updating for the guide point or can adjust the rate at which the guide point is periodically updated. Of course, both of these concepts could be employed for operation of the invention as illustrated in FIG. 3.

Figure 6:
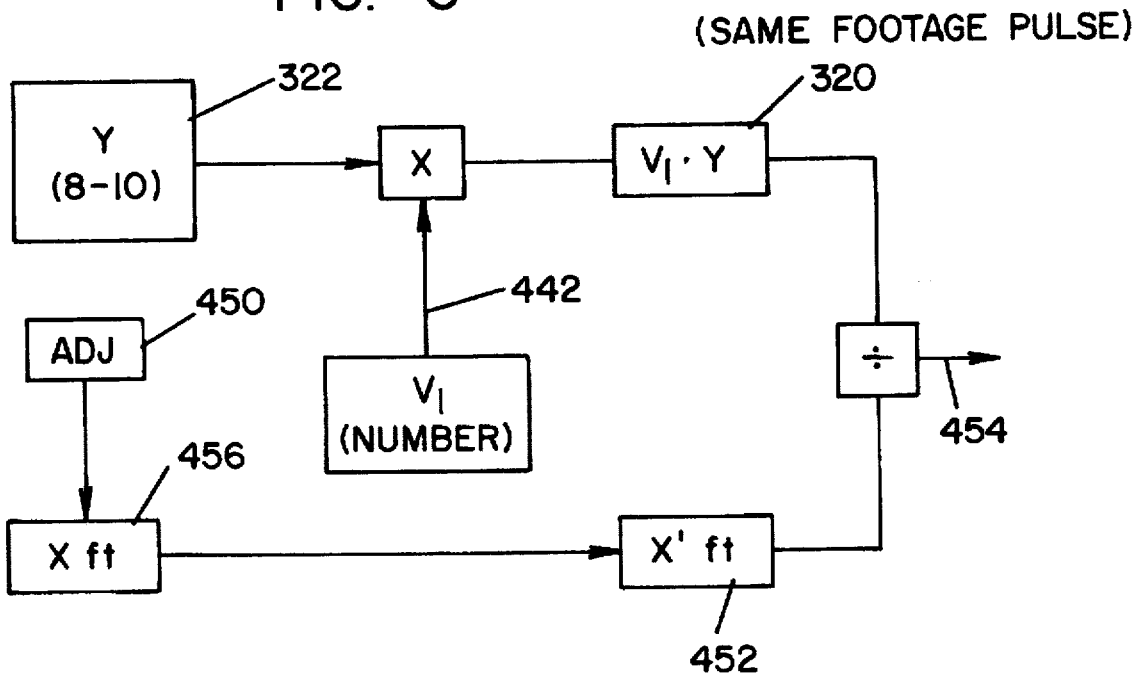
FIG. 6 is a block diagram of the subroutine used in implementing the output of the circuit shown in FIG. 5 for changing the phase lag of the system illustrated in FIG. 3.

A more detailed subroutine for using the number on line 442 to adjust the pulse rate in line 242 in accordance with the variable strip length in accumulator AC is illustrated in FIG. 6 wherein the number in line 442 adjusts the sensitivity value Y in block 322 by the number on line 442. The strip length X, which is fixed in counter 240, can be adjusted by manually increasing the value X by block 450 to produce a new value X' as shown at block 452. The number on line 442 is divided by the number in block 420 to produce the count value on line 454 to which the counter 240 is set. In this manner, the fixed value for the spacing between locations III and IV in block 456 is adjusted manually to a new number. A real time adjustment from the accumulator AC is accomplished for creating the desired number in line 454 which is used in counter 240.

Figure 7:
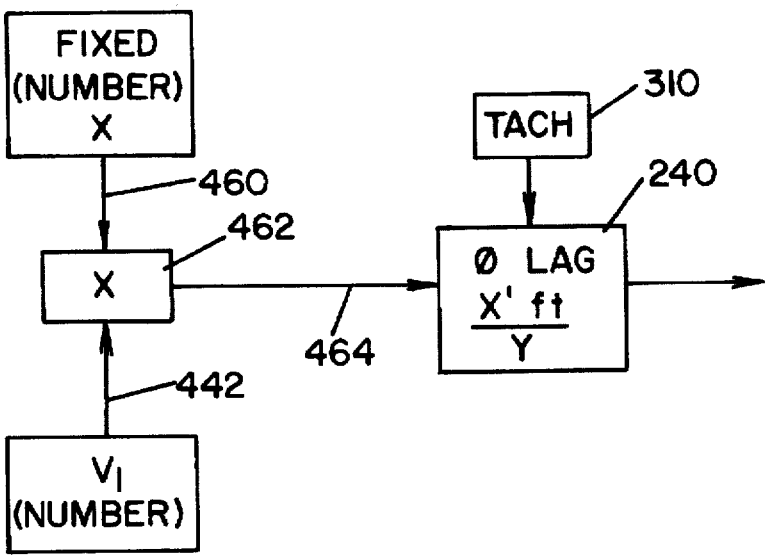
FIG. 7 is a subroutine shown in block form implementing a phase lag utilizing the output of the accumulator circuit shown in FIG. 5; and, FIG. 8 is a side plan view showing a payout reel and a strip position correcting roll at the spaced locations of the present invention.

In accordance with still a further aspect of the invention, the number forming the output on line 442 from accumulator AC can be used to adjust a standard phase lag control circuit, shown as control device 240 in FIG. 7. In this aspect of the invention, a fixed number X appears in line 460 and is multiplied by device 462 to create a new value X' for use in control device 240. A tachometer 310 controls phase lag control device 240 in accordance with the adjusted number on line 464. The number on output 442 from accumulator AC can be used for phase log control of various systems having a remote detector or measuring device that would be affected by an intermediate accumulator AC, as shown in FIG. 5.

Figure 8:
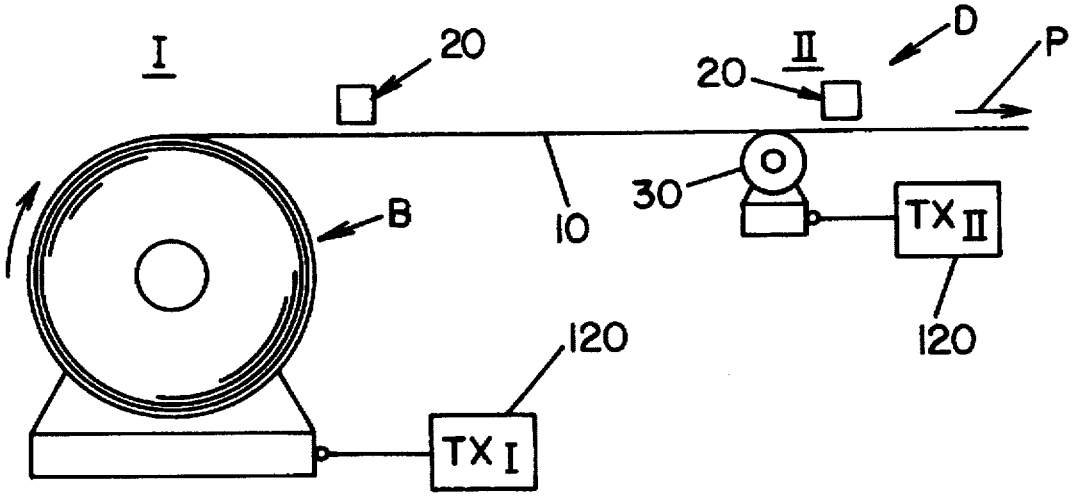

FIG. 8 shows that the spaced locations on path P can include the payout reel B and the first camber control device D. In practice the primary use is between two spaced locations such as locations III and IV.

Having thus defined the invention, the following is claimed:

1. Apparatus for guiding a strip traveling along a path past a first location on said path and then past a second location on said path, said apparatus including means for providing first and second position signals respectively indicative of an actual position of said strip at said first and second locations, means for providing first and second guide point signals respectively indicative of a desired position for said strip at said first and second locations, means providing first and second error signals respectively indicative of the difference between said actual and desired positions for said strip at said first and second locations, first and second actuator means respectively at said first and second locations and displaceable respectively in response to said first and second error signals for displacing said strip from said actual position toward said desired position respectively at said first and second locations, first and second means for respectively determining the extent of displacement of said first and second actuator means in response to said first and second error signals and respectively providing first and second correction signals respectively indicative of the extent of displacement of said first and second actuator means, means for comparing said first and second correction signals and providing a control signal indicative of the difference between the extents of displacement of said first and second actuator means, and means responsive to said control signal for adjusting said first guide point signal for balancing the extents of displacement of said first and second actuator means.

2. Apparatus as defined in claim 1, wherein said means responsive to said control signal includes means for adjusting said first guide point signal to reduce said control signal.

3. Apparatus as defined in claim 2, further including means for producing a gain signal for said control signal, and means for multiplying said control signal by said gain signal.

4. Apparatus as defined in claim 3, further including means for adjusting said gain signal.

5. Apparatus as defined in claim 4, wherein said strip has a length between said first and second locations and said means for adjusting said gain signal includes means for determining said length of said strip between said first and second locations and means for adjusting said gain signal in accordance with said length.

6. Apparatus as defined in claim 5, wherein said length varies as said strip moves along said path and said means for determining said length includes means for monitoring changes in said length as said strip moves along said path.

7. Apparatus as defined in claim 1, further including means for providing a gain signal for said control signal, and means for multiplying said control signal by said gain signal.

8. Apparatus as defined in claim 7, further including means for adjusting said gain signal.

9. Apparatus as defined in claim 8, wherein said strip has a length between said first and second locations and said means for adjusting said gain signal includes means for determining said length of said strip between said first and second locations and means for adjusting said gain signal in accordance with said length.

10. Apparatus as defined in claim 1, wherein said strip has a length between said first and second locations and travels along said path at a velocity, means for determining said velocity, means for periodically producing a phase lag signal at a rate based on said velocity, said means responsive to said control signal including means for adjusting said first guide point signal in response to said phase lag signal.

11. Apparatus as defined in claim 10, wherein said velocity is variable, said means for determining said velocity includes means for sensing variations in said velocity, and said means for periodically producing said phase lag signal includes means for producing said phase lag signal at a variable rate based on said variations.

12. Apparatus as defined in claim 11, wherein said means for determining said velocity includes pulse generating means for producing pulses at a rate corresponding to said velocity.

13. Apparatus as defined in claim 10, further including means for determining said length of said strip between said first and second locations and means for adjusting said phase lag signal in accordance with said length.

14. Apparatus as defined in claim 13, wherein said length varies as said strip moves along said path and said means for determining said length includes means for monitoring changes in said length as said strip moves along said path.

15. Apparatus as defined in claim 1, wherein said first and second correction signals and said control signal are digital signals.

16. Apparatus for guiding a strip traveling along a selected path past a first location on said path and then past a second location on said path, said apparatus comprising first camber correcting means for correcting the camber of said strip at said first location relative to a first guide point, means for sensing the amount of correction at said first location, second camber correcting means for correcting the camber of said strip at said second location relative to a second guide point, means for sensing the amount of correction at said second location, and means for adjusting said first guide point based upon the difference between the sensed amounts of correction at said first and second locations for balancing said amounts of correction.

17. Apparatus as defined in claim 16, further including means for determining the difference between said sensed amounts of correction at said first and second locations, said means for adjusting said first guide point including means for adjusting said first guide point to reduce said difference.

18. Apparatus as defined in claim 17, wherein said means for determining said difference includes means providing a control signal indicative of said difference, means for producing a gain signal for said control signal, and means for multiplying said control signal by said gain signal.

19. Apparatus as defined in claim 18, further including means for adjusting said gain signal.

20. Apparatus as defined in claim 19, wherein said strip has a length between said first and second locations and said means for adjusting said gain signal includes means for determining said length of said strip between said first and second locations and means for adjusting said gain signal in accordance with said length.

21. Apparatus as defined in claim 16, wherein said strip has a length between said first and second locations and travels along said path at a velocity, means for determining said velocity, means for periodically producing a phase lag signal at a rate based on said velocity, said means for adjusting said first guide point including means for adjusting said first guide point in response to said phase lag signal.

22. Apparatus as defined in claim 21, further including means for adjusting said phase lag signal.

23. Apparatus as defined in claim 22, wherein said means for adjusting said phase lag signal includes means for determining said length of said strip between said first and second locations and means for adjusting said phase lag signal in accordance with said length.

24. A method for guiding a strip traveling along a selected path past a first location on said path and then past a second location on said path, said method comprising the steps of:

(a) correcting the camber of said strip at said first location toward a first guide point;

(b) sensing the amount of correction at said first location;

(c) correcting the camber of said strip at said second location toward a second guide point;

(d) sensing the amount of correction at said second location;

(e) determining the difference between the amounts of correction at said first and second locations; and (f) adjusting said first guide point based upon the difference between the amounts of correction at said first and second locations.

25. The method as defined in claim 24, including the further step of:

(g) adjusting said first guide point to reduce said difference.

26. The method as defined in claim 25, including further step of:

(h) producing a signal representing said difference and multiplying said signal by a gain value.

27. The method as defined in claim 24, wherein said adjusting said first guide point includes the further steps of:

(f) determining the velocity of said strip;

(g) periodically producing a phase lag signal at a rate based on said velocity; and (h) making said adjustment of said first guide point periodically in response to said phase lag signal.

28. The method as defined in claim 27, including the further step of:

(i) adjusting said phase lag signal.

29. The method as defined in claim 28, wherein said adjusting said phase lag signal includes the steps of:

(j) determining the length of said strip between said first and second locations; and, (k) adjusting said phase lag signal in accordance with said length.

30. The method as defined in claim 29, wherein said length of said strip varies as said strip moves along said path and said determining the length of said strip includes the step of:

(l) monitoring changes in said length as said strip moves along said path.

31. In a strip guiding system for correcting the lateral position of a strip moving at a speed along a path between first and second spaced locations, said strip having a length between said locations and said system including position correcting means at said first location for correcting the lateral position of said strip at said first location, means including strip position detecting means at said second location for producing a correction signal for said position correcting means, said means for producing a correction signal further including phase lag control means for periodically transmitting said correction signal to said position correcting means at a rate dependent on said speed and said length of said strip, and means for providing said phase lag control means with first and second signals respectively indicative of said speed and said length of said strip, the improvement comprising: a multiple run strip accumulator between said first and second locations, said accumulator being expandable and contractible to change said length by respectively increasing and decreasing said length between said first and second locations, means responsive to expansion and contraction of said accumulator for producing an adjusting signal indicative of a change in said length of said strip between said first and second locations, said means for providing said phase lag control means with said first and second signals including means responsive to said adjusting signal for adjusting said second signal.

32. The improvement according to claim 31, wherein said strip has a length in said accumulator, said accumulator has input and output rolls spaced apart a fixed distance along said path, idler rolls spaced from said path, and means supporting said idler rolls for displacement toward and away from said input and output rolls for changing said length of said strip in said accumulator, said means for producing said adjusting signal including means providing a third signal indicative of said fixed distance, means for producing a fourth signal indicative of the distance between said idler rolls and said input and output rolls, and means for producing said adjusting signal in response to said third and fourth signals.

* * * * *